United States Patent [19]

Skinner

[11] Patent Number: 4,498,905

[45] Date of Patent: Feb. 12, 1985

[54] METHOD FOR DEACTIVATING AND CONTROLLING THE DUSTING TENDENCIES OF DRIED PARTICULATE LOWER RANK COAL

[75] Inventor: James L. Skinner, Plano, Tex.

[73] Assignee: Atlantic Richfield Company, Los Angeles, Calif.

[21] Appl. No.: 646,181

[22] Filed: Aug. 31, 1984

Related U.S. Application Data

[63] Continuation-in-part of Ser. No. 547,517, Oct. 31, 1983.

[51] Int. Cl.[3] ..... C10L 1/00; C10L 5/04; C10L 5/24; C10L 5/32

[52] U.S. Cl. ..... 44/1 C; 44/112; 44/6; 44/15 A; 44/15 R; 44/24

[58] Field of Search ..... 44/1 C, 6, 15 A, 15 R, 44/24

[56] References Cited

U.S. PATENT DOCUMENTS

| | | | |
|---|---|---|---|
| 1,224,641 | 5/1917 | Hite | 44/24 |
| 1,886,633 | 11/1932 | Broeman | 44/6 |
| 2,098,232 | 11/1937 | Fife | 44/6 |
| 2,138,825 | 12/1938 | Allen | 44/6 |
| 2,222,945 | 11/1940 | Groll, Jr. et al. | 44/6 |
| 2,278,413 | 4/1942 | Campbell | 44/6 |
| 2,338,634 | 1/1944 | Fuchs | 44/1 R |
| 2,383,543 | 8/1947 | Gray | 44/6 |
| 2,492,132 | 12/1949 | Payne et al. | 34/13 |
| 2,610,115 | 9/1952 | Lykken | 44/6 |
| 2,844,886 | 7/1958 | Nathan | 208/8 R |
| 2,854,347 | 9/1958 | Booth et al. | 117/6 |
| 3,250,016 | 5/1966 | Agarwal | 34/10 X |
| 3,309,780 | 3/1967 | Goins | 434/57 R |
| 3,723,079 | 3/1973 | Seitzer | 44/1 R |
| 3,985,516 | 10/1976 | Johnson et al. | 44/6 |
| 3,985,517 | 10/1976 | Johnson | 44/6 |
| 4,008,042 | 2/1977 | Auvil et al. | 432/26 |
| 4,169,321 | 10/1979 | Nichols | 34/23 |
| 4,201,657 | 5/1980 | Anderson et al. | 44/6 |
| 4,247,991 | 2/1981 | Mehta | 34/35 |
| 4,265,637 | 5/1981 | Anderson | 44/6 |
| 4,275,668 | 6/1981 | Daman | 110/245 |
| 4,324,544 | 4/1982 | Blake | 432/14 |
| 4,331,445 | 5/1982 | Burns | 44/6 |
| 4,354,825 | 10/1982 | Fisher et al. | 432/14 |
| 4,396,394 | 8/1983 | Li et al. | 44/16 |
| 4,396,395 | 8/1983 | Skinner et al. | 44/6 |
| 4,402,707 | 9/1983 | Wunderlich | 44/6 |
| 4,403,996 | 9/1983 | Matsuura et al. | 44/6 |
| 4,421,520 | 12/1983 | Matthews | 44/6 |

FOREIGN PATENT DOCUMENTS

| | | | |
|---|---|---|---|
| 1526429 | 6/1956 | Canada | 44/24 |
| 21493 | 2/1982 | Japan | 44/24 |

*Primary Examiner*—Delbert E. Gantz
*Assistant Examiner*—Helane Myers
*Attorney, Agent, or Firm*—F. Lindsey Scott

[57] ABSTRACT

Dried particulate low rank coal fuel having a reduced reactivity and a reduced dusting tendency is produced from dried particulate low rank coal by a method consisting essentially of: intimately contacting the dried particulate low rank coal with a deactivating oil in an amount sufficient to reduce the reactivity of the dried coal by a desired amount and thereafter intimately contacting the deactivated dried coal with a dedusting oil in an amount sufficient to reduce the dusting tendency of the deactivated dried coal by a desired amount. The deactivating oil has a 5 percent point in excess of about 900° F. and the dedusting oil has a 5 percent point from about 400° F. to about 750° F.

10 Claims, 1 Drawing Figure

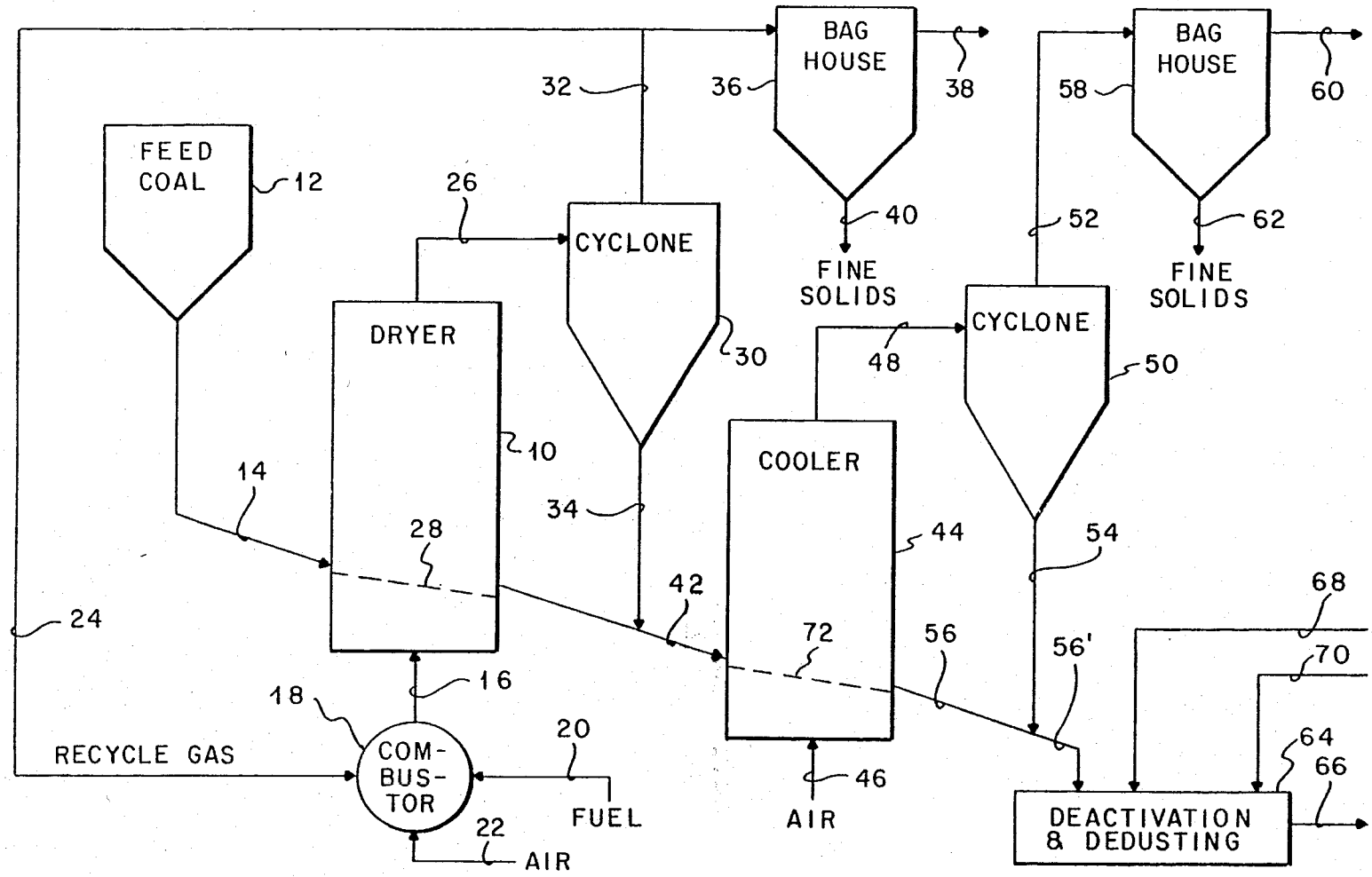
FEED COAL
DRYER
CYCLONE
BAG HOUSE
FINE SOLIDS
COOLER
AIR
CYCLONE
BAG HOUSE
FINE SOLIDS
DEACTIVATION & DEDUSTING
COM-BUS-TOR
FUEL
AIR
RECYCLE GAS
10
12
14
16
18
20
22
24
26
28
30
32
34
36
38
40
42
44
46
48
50
52
54
56
56'
58
60
62
64
66
68
70
72

METHOD FOR DEACTIVATING AND CONTROLLING THE DUSTING TENDENCIES OF DRIED PARTICULATE LOWER RANK COAL

This application is a continuation-in-part of my earlier filed application, U.S. Ser. No. 547,517, entitled "A Method for Deactivating and Controlling the Dusting Tendencies of Dried Particulate Lower Rank Coal", filed Oct. 31, 1983.

This invention relates to a method for deactivating and controlling the dusting tendencies of dried particulate lower rank coal.

This invention further relates to a method for deactivating and controlling the dusting tendencies of a dried particulate lower rank coal by contacting such dried coal with a deactivating oil and a dedusting oil.

In many instances, coal as mined, contains undesirably high quantities of water for transportion and use as a fuel. This problem is common to all coals, although in higher rank coals such as anthracite and bituminous coals, the problem is less severe because the water content of the coal is normally lower and the heating value of such coals is higher. The situation is different with respect to lower rank coals such as sub-bituminous, lignite and brown coals. Such coals as produced typically contain from about 20 to about 65 weight percent water. While many such coals are desirable as fuels because of their relatively low mining cost and because of their relatively low sulfur content, the use of such lower rank coals as fuel has been greatly inhibited by the fact that as produced they typically contain a relatively high percentage of water. Attempts to dry such coals for use as a fuel have been inhibited by the tendency of such coals after drying to undergo spontaneous ignition and combustion in storage, transportation or the like. Further, the reactivity of the dried lower rank coal has resulted in handling problems in drying processes. In particular, in handling problems in drying processes. In particular, when finely divided particles of dried lower rank coals are exposed to elevated temperatures and the like, they are very readily ignited and present explosion and fire hazards.

The drying required with lower rank coals is a deep drying process for the removal of surface water plus large quantities of inherent water present in the lower rank coals. By contrast, when higher grade coals, such as anthracite and bituminous coal, are dried, the drying is commonly for the purpose of drying surface water from the coal particle surfaces but not inherent water since the inherent water content of such higher rank coals is relatively low. As a result, short residence times in the drying zone are normally used and the interior portions of the coal particles are not heated since such is not necessary for surface drying. Normally the coal leaving the dryer in such surface water drying processes with higher rank coal is at a temperature below about 150° F. (about 65° C.) and more typically below about 110° F. (about 45° C.). By contrast, processes for the removal of inherent water require longer residence times and result in heating the interior portions of the coal particles. For instance, lower rank coal is typically retained in the drying zone at a temperature from about 170° to about 250° F. (about 75° to about 120° C.) for periods of time varying from about 3 to about 8 minutes in lower rank coal drying processes. As a result, the dried coal leaving a drying process for the removal of inherent water will typically be at a temperature from about 130° to about 250° F. (about 54° to about 120° C.). When such processes for the removal of inherent water are applied to lower rank coals, the resulting dried coal has a strong tendency to spontaneously ignite especially at the high discharge temperatures at which it leaves the dryer and also upon storage, during transportation and the like. Further, the dried lower rank coal product tends to contain substantial amounts of very finely divided particulate coal solids. In addition to the production of such solids by attrition in the fluidized beds, the lower rank coal upon drying tends to become very friable and in some instances partially disintegrate to produce finely divided coal particles. As a result, it is necessary in many instances in order to produce a saleable dried lower rank coal fuel product that the dried lower rank coal be treated to reduce its dusting tendencies.

In such processes for drying lower rank coal, a cooling step may be used to reduce the temperature of the dried coal to a temperature below about 100° F. (about 38° C.). To further reduce the reactivity of the dried lower rank coal, deactivating fluids may be used. Some suitable deactivating fluids are materials, such as oil, as disclosed in U.S. Pat. No. 4,402,707, issued Sept. 6, 1983 to Wunderlich entitled "Deactivating Dried Coal With a Special Oil Composition" and latex formulations as disclosed in U.S. Pat. No. 4,421,520 issued 12/20/83 to Matthews and entitled "Reducing the Tendency of Dried Coal to Spontaneously Ignite" (now U.S. Ser. No. 333,146, filed Dec. 21, 1981), both of which are hereby incorporated in their entirety by reference. These materials are used to reduce the tendency of the dried lower rank coal to spontaneously ignite upon storage, transportation or the like. Normally, a predetermined degree of deactivation is desired and the amount of deactivating fluid to be used is selected to accomplish this degree of deactivation.

While deactivating and dedusting are accomplished by the use of such materials, the cost of the deactivating fluids is high relative to the value of the dried particulate coal product. Since it is necessary from a practical point of view to control the tendency to spontaneously ignite and to reduce the dusting tendency to an acceptable level, continuing efforts have been directed to the development of methods for reducing the tendency of dried particulate lower rank coal to spontaneously ignite and for reducing the tendency of dried particulate lower rank coal to produce dust upon handling to acceptable levels.

In the preparation of this application, the following U.S. patents were considered: U.S. Pat. Nos. 4,201,657; 2,338,634; 4,275,668; 4,324,544; 3,250,016; 3,723,079; 2,844,886, 3,985,517; 4,008,042; 1,886,633; 2,098,232; 3,985,516; 2,854,347; 2,222,945; 2,278,413; 2,138,825; 4,331,445; 4,247,991; 4,169,321; 3,309,780; 2,492,132; and 4,354,825. U.S. Pat. No. 4,201,657 discloses a deactivating oil composition. These references are hereby incorporated in their entirety by reference.

According to the present invention, a dried particulate coal fuel having a reduced reactivity and a reduced dusting tendency is produced from a dried particulate low rank coal by a method consisting essentially of: (a) intimately contacting the dried coal with a deactivating oil in an amount sufficient to reduce the reactivity of the dried coal by a desired amount, the deactivating oil having a 5 percent point in excess of about 900° F. to produce deactivated dried coal; and thereafter (b) intimately contacting the deactivated dried coal with a dedusting oil in an amount sufficient to reduce the dusting tendency by a desired amount, the dedusting oil having a 5 percent point from about 400° F. to about 750° F. to produce deactivated dried coal having a reduced dusting tendency.

The FIGURE is a schematic diagram of a process embodying the present invention.

In the discussion of the FIGURE, the term "line" will be used to refer to conduits, conveyors and the like as commonly used for the transport of solids, liquids or gases.

In the FIGURE, particulate low rank coal is fed to a dryer 10 which includes a support 28 which is normally a grate or the like. A bed of fluidized particulate coal is at least partially fluidized above support 28 by hot fluidizing gas which is charged to dryer 10 through a line 16. Particulate low rank coal is fed to dryer 10 from a coal feeder 12 via a line 14. The temperatures commonly used in the bed of fluidized coal in dryer 10 are from about 170° to about 250° F. (about 75° about 120° C.). Residence times in dryer 10 from about 3 to about 8 minutes are typical. The hot fluidizing gas charged to dryer 10 through line 16 is produced in a combustor 18 by combusting fuel supplied through a line 20 with air supplied through a line 22. A recycle gas stream (line 24) comprising exhaust gas from dryer 10 is used to modify the temperature of the hot fluidizing gas in line 16. Exhaust gas is recovered from dryer 10 through a line 26 and passed to a cyclone 30 where fine particulate solids are removed from the exhaust gas stream and recovered through a line 34 with at least a portion of the overhead stream from cyclone 30 being passed through a line 32 to a baghouse 36 where additional fine solids are removed from the overhead stream via a line 40 with the cleaned gas being exhausted from baghouse 36 through a line 38. The fine solids recovered through line 34 are optionally combined with the dried coal product from dryer 10. The dried coal product is passed through a line 42 from dryer 10 to a cooler 44. The dried coal product is maintained in cooler 44 as a fluidized or semi-fluidized bed above a grate or support 72 by the flow of cooling air supplied through a line 46. Exhaust gas from cooler 44 is recovered through a line 48 and passed to a cyclone 50 where finely divided solids are separated from the exhaust gas stream and recovered through a line 54. The overhead gas from cyclone 50 is then passed through a line 52 to a baghouse 58 where fine solids are recovered via a line 62 from the overhead gas stream which is then exhausted from baghouse 58 through a line 60. Both the exhaust gas recovered from baghouse 36 through line 38 and the exhaust gas recovered from baghouse 58 through line 60 may require further treatment, etc. before exhausting to the atmosphere. Such treatments of exhaust gas streams for environmental or other purposes is not considered to comprise a part of the present invention.

The fine solids recovered through line 54 are typically combined with the cooled dried coal product from cooler 44 which is recovered through a line 56 and passed to a deactivation and dedusting zone 64. Dried, deactivated coal having a reduced dusting tendency is recovered from deactivation and dedusting zone 64 through a line 66. A deactivating oil is supplied to zone 64 via a line 68 and a dedusting oil is supplied to zone 64 via a line 70.

Processes for the production of dried low rank coal are known to those skilled in the art and have been shown for instance in U.S. Pat. No. 4,396,394, issued Aug. 2, 1983 to Li et al entitled "A Method For Producing A Dried Coal Fuel Having A Reduced Tendency To Spontaneously Ignite From A Low Rank Coal" and in U.S. Pat. No. 4,354,825 issued Oct. 19, 1982 to Fisher et al entitled "Method And Apparatus For Drying Coal", both of which are hereby incorporated in their entirety by reference. The method of the present invention is useful with a variety of such processes for the production of dried low rank coal.

In such processes, the dried low rank coal product tends to be highly reactive to the extent that spontaneous ignition and combustion of the dried low rank coal product is frequently a problem and the dried low rank coal product normally contains substantial amounts of very finely divided particulate coal solids. In addition to the production of such solids by attrition in the fluidized beds, the low rank coal upon drying tends to become very friable and in some instances partially disintegrate to produce finely divided coal particles. As a result, it is necessary in many instances in order to produce a saleable dried coal fuel product that the dried low rank coal be treated to deactivate the dried low rank coal and to reduce its dusting tendencies.

According to the present invention, both these requirements are satisfied by first treating the dried low rank coal with a deactivating oil in an amount sufficient to reduce its reactivity by a desired amount and thereafter contacting the deactivated dried coal with a dedusting oil to reduce its dusting tendency by a desired amount.

In the practice of the present method, substantially any heavy oil having a 5 percent point in excess of about 900° F. can be used as the deactivating oil. Many such oils are available although many such oils are highly carcinogenic. A particularly suitable oil is disclosed in U.S. Pat. No. 4,402,707 issued Sept. 6, 1983 to Wunderlich entitled "Deactivating Dried Coal With A Special Oil Composition". The oil described therein is a virgin vacuum reduced crude with a 5 percent point in excess of 900° F., a characterization factor of 10.8 or greater, and a minimum flash point of 400° F. or greater. The oil is obtained by vacuum reduction of crude oil under conditions such that minimal thermal cracking of the crude oil during vacuum reduction occurs. The characterization factor of such oils is a special physical property of hydrocarbons defined by the relationship:

$$K=(T_b^{\frac{1}{3}}/G)$$

where $K$ = Characterization factor $T_b$ = Cubic average boiling point °R.

$G$ = Specific gravity 60° F./60° F.

°R = °F. + 460.

The cubic average boiling point is determined in accordance with the calculations mentioned in an article entitled "Boiling Points and Critical Properties of Hydrocarbon Mixtures," by R. L. Smith and K. M. Watson, appearing in Industrial and Engineering Chemistry, Volume 29, pages 1408–1414, December, 1937, and using the ten, thirty, fifty, seventy, and ninety percent points °F. as measured by the procedures of ASTM D1160-77 or ASTM D86 entitled "Standard Method for Distillation of Petroleum Products," published in the 1978 Annual Book of ASTM Standards, Part 23. ASTM D86 is for products which decompose when distilled at atmospheric pressure.

A difference of a few tenths in characterization factor may seem small; but this factor is readily determined to an accuracy of 0.1 and it can be used and interpreted with considerable confidence and reliability. This factor is useful in identifying hydrocarbons. For example, materials with a characterization factor of 9.5 are pure polynuclear aromatics called PNA which are highly carsinogenic substances. On the other end of the scale, materials with a characterization factor of 13 are pure paraffins like innocuous vaseline. The characterization factor correlates well with many other physical properties of an oil, such as, molecular weight, viscosity, thermal expansion, specific heat, critical properties, heat of combustion, and the like.

Oils such as those disclosed in U.S. Pat. No. 4,402,707 are highly desirable as deactivating oils since they are less carcinogenic than many heavy oils and since they are extremely effective. The 5 percent point is desirably in excess of about 900° F., and preferably is in excess of about 1000° F. The dried low rank coal is intimately contacted with the deactivating oil in any suitable contacting equipment. One suitable apparatus is shown in U.S. Pat. No. 4,396,395 issued Aug. 2, 1983 to Skinner et al entitled "Method and Apparatus for Contacting Particulate Coal and a Deactivating Fluid". The use of such oils is highly effective in reducing the reactivity of such dried low rank coal. This use of such oils is also effective in reducing the tendency of such dried low rank coal to readsorb water. The amount of deactivating oil used is normally based upon the accomplishment of a desired reduction in the reactivity of the dried low rank coal product. More particularly, some standard of reactivity is normally selected as safe and suitable for the transportation, storage and use of the dried low rank coal and the reactivity of the dried low rank coal is then reduced to this level. Commonly, the level of reactivity chosen as safe and suitable is that of the undried low rank coal. In other words, if such undried low rank coal can or has been safely mined, transported and used as a fuel, then there is little reason to reduce the reactivity of the dried low rank coal below the level which has been found to be safe and suitable with the undried low rank coal. Typically, the reactivity is measured as a function of the rate of oxidation of the dried low rank coal or the undried low rank coal as the case may be. Typically, amounts of deactivating oil in excess of about 0.5 gallons of oil per ton of dried low rank coal will be required when the dried low rank coal contains less than 10 weight percent water. In some instances, amounts as high as 2 gallons per ton of dried low rank coal may be required.

While Applicant does not wish to be bound by any particular theory, it appears that when the deactivating oil having a high initial boiling point is used to intimately contact the dried low rank coal, the heavy oil forms a coating on the coal particles rather than wicking into or otherwise absorbing into the dried coal particles. The net result appears to be a coating of the dried coal particles rather than absorption of the oil by the coal particles. Such a coating tends to limit the exposure of the dried coal surfaces and pores to oxygen contained in the air. In any event, it has been found that the use of heavy oils having a 5 percent point in excess of about 900° F. is much more effective than the use of oils having a 5 percent point lower than about 900° F.

While the amount of oil required to deactivate the dried low rank coal product can be determined by comparison of the oxidation rate of the dried low rank coal product with that of the desired standard, it may be found that even after deactivating the dried low rank coal to the desired level of reactivity, the deactivated dried low rank coal still has an unacceptable tendency to generate dust upon handling, shipment and the like. In such instances, additional quantities of deactivating oil can be used, but it is to be noted that the heavy oil is expensive relative to the dried low rank coal product and the use of large amounts of the deactivating oil tends to be prohibitively expensive. Accordingly, it is highly desirable that the amounts of deactivating oil required be minimized. The amount of deactivating oil required is minimized to a great extent by the use of the very heavy oils discussed above.

The amount of deactivating oil required can be optimized by the use of a second treating step as required to control the dusting tendencies of the dried coal product. The amount of dusting tendency reduction required is also a function in many instances of the dusting tendencies of the existing product. In other words, if the dust levels resulting from the use of the existing product, i.e. undried low rank coal or a competing product, are acceptable, then normally the same level of dusting is acceptable in the dried low rank coal fuel. The dusting tendency of coals may be measured by a standard ASTM procedure (ASTM: D547-41 [reapproved 1980]) entitled "Standard Test Method for Index of Dustiness of Coal and Coke." By the use of such test procedures, the dusting tendencies of various coal products can be determined and the dusting tendencies of the dried low rank coal can be controlled as necessary by contacting the deactivated dried low rank coal with a dedusting oil in an amount sufficient to reduce the dusting tendency of the deactivated dried low rank coal to a desired level. When deactivated dried low rank coal is treated by the method of the present invention, a variety of dedusting fluids can be used. Such dedusting oils desirably have a 5 percent point from about 400° F. to about 750° F. and can be selected from substantially any oil in that boiling range. Desirably, the dedusting oil is a petroleum derived oil; is selected from highly paraffinic stocks and has a 5 percent point above about 450° F. and an end point from about 800° F. to about 1200° F. Some suitable dedusting oils are materials such as medium heavy vacuum resids, heavy resids, waxes, gas oils, asphalts and the like. Preferred waxes are waxes having a softening point greater than about 120° F. and desirably above about 150° F. No effort has been made to list all suitable oils since it is believed that most oils in the desired range will be found suitable. In some instances, such oils may leave the surface of the dedusted dried coal product slightly tacky thereby resulting in a tendency to retain dust particles on the surface. In other instances, when heavier dedusting oils are used, the surface may not be at all tacky. In other instances, when heavier dedusting oils are used, the surface may not be at all tacky. Lighter oils which would tend to absorb into the dried coal, thus requiring unacceptably large amounts of oil for deactivation or dedusting if sprayed on the untreated coal can be used effectively in small amounts after the dried coal has been treated with deactivating oil as discussed above.

The use of separate steps for deactivation and dust control results in the ability to control the deactivation and dedusting processes more closely so that no more oil is used for either purpose than is necessary to accomplish the desired objectives. Both coating steps may be conveniently conducted in the same vessel with lines being provided to supply deactivating oil and dedusting oil to the vessel. A wide variety of contacting vessels may be used. Contacting vessels suitable for use in applying the deactivating oil as discussed above may also be used in the application of the dedusting oil.

In some instances, it may be necessary to treat all the coal both for deactivation and for dust control. In other instances, it may not be necessary to treat all the dried coal for both deactivation and dust control and it may be found that treating only a portion of the deactivated dried coal product will be effective to reduce the dusting tendency to a desired level. Materials which would not be effective in small amounts as a deactivating oil can be used as a dedusting oil after the deactivating step using the heavy oil has been accomplished. This results in the ability to use more readily handled and, in some instances, more economical materials for the dedusting step.

While normally the dried low rank coal product is treated for deactivation and dedusting after the cooling operation, it is noted that both the deactivation and the dedusting treatment could be performed prior to cooling the dried low rank coal product. Such is considered to be less desirable for a variety of reasons. Similarly, the dried coal product could be deactivated prior to cooling with the dedusting step being accomplished after the cooling operation. This variation is also considered to be less desirable.

As noted previously, a variety of processes can be used to produce the dried low rank coal product treated by the method of the present invention for deactivation and dust control. The present invention is not dependent upon the particular method by which the dried coal product treated is produced. Similarly, a variety of contacting vessels can be used for both the deactivation and the dedusting steps within the scope of the present invention.

Having thus described the present invention by reference to certain of its preferred embodiments, it is noted that the embodiments described are illustrative rather than limiting in nature and that many variations and modifications are possible within the scope of the present invention. Many such variations and modifications may appear obvious and desirable to those skilled in the art based upon a review of the foregoing description of preferred embodiments.

Having thus described the invention, I claim:

1. A method for deactivating and controlling the dusting tendencies of dried particulate lower rank coal, said method consisting essentially of:

(a) intimately contacting said dried coal with a deactivating oil in an amount sufficient to reduce the reactivity of said dried coal by a desired amount, said deactivating oil having a 5 percent point in excess of about 900° F. to produce deactivated dried coal; and thereafter (b) intimately contacting said deactivated dried coal with a dedusting oil in an amount sufficient to reduce the dusting tendency by a desired amount, said dedusting oil having a 5 percent point from about 400° F. to about 750° F. to produce deactivated dried coal having a reduced dusting tendency.

2. The method of claim 1 wherein said deactivating oil has a 5 percent point in excess of about 1000° F.

3. The method of claim 2 wherein said dedusting oil is a petroleum derived, paraffinic oil having a 5 percent point above about 450° F. and an end point from about 800° F. to about 1200° F.

4. The method of claim 1 wherein the dusting tendency of said dried coal is reduced to a value no greater than the value for the fresh undried low rank coal.

5. The method of claim 4 wherein said amount of said dedusting oil is at least about 0.5 gallons per ton of dried coal.

6. The method of claim 5 wherein said amount is from about 0.5 to about 4.0 gallons per ton of dried coal.

7. The method of claim 1 wherein said amount of said deactivating oil is at least 0.5 per ton of said dried coal.

8. The method of claim 7 wherein said amount of said deactivating oil is from about 0.5 to about 2.0 gallons per ton of said dried coal.

9. The method of claim 7 wherein said deactivating oil is a virgin vacuum reduced crude with a characterization factor at least as high as 10.8 and a flash point at least as high as 400° F.

10. The method of claim 1 wherein said deactivated dried coal has a reduced tendency to readsorb water.

* * * * *